US005738167A

United States Patent [19]

Asbjornson et al.

[11] Patent Number: 5,738,167

[45] Date of Patent: Apr. 14, 1998

[54] BLOWER FAN HOUSING ASSEMBLY

[75] Inventors: Norman H. Asbjornson; Henry C. Bierwirth, both of Tulsa, Okla.

[73] Assignee: Aaon, Inc., Tulsa, Okla.

[21] Appl. No.: 598,371

[22] Filed: Feb. 8, 1996

[51] Int. Cl.[6] ..... F28F 13/12; F04D 29/44

[52] U.S. Cl. ..... 165/122; 415/119; 415/203; 415/206; 417/313; 417/362

[58] Field of Search ..... 165/122, 78; 417/313, 417/362, 423.14; 415/206, 203, 119

[56] References Cited

U.S. PATENT DOCUMENTS

| | | | |
|---|---|---|---|
| 704,038 | 7/1902 | Hope . | |
| 2,464,473 | 3/1949 | Wessel | 415/213.1 |
| 2,631,776 | 3/1953 | Palmer | 415/213.1 |
| 3,117,715 | 1/1964 | Bloomingdale | 415/140 |
| 3,153,388 | 10/1964 | Cheely | 417/362 |
| 3,339,831 | 9/1967 | Ranz | 415/206 |
| 3,726,611 | 4/1973 | Astrom | 417/423 R |
| 3,734,122 | 5/1973 | Cousins | 417/313 X |
| 3,746,464 | 7/1973 | Goettl | 415/201 |
| 3,811,790 | 5/1974 | Mikulina et al. | 415/145 |
| 3,874,191 | 4/1975 | Hudson . | |
| 3,950,835 | 4/1976 | Bennink et al. | 415/206 X |
| 4,130,376 | 12/1978 | Dietsche | 415/213.1 |
| 4,337,823 | 7/1982 | Del Percio | 165/122 X |
| 5,324,178 | 6/1994 | Escaravage . | |

FOREIGN PATENT DOCUMENTS

| | | | |
|---|---|---|---|
| 174077 | 1/1961 | Sweden | 417/362 |

*Primary Examiner*—Leonard R. Leo

[57] ABSTRACT

An energy efficient housing assembly employing a single inlet backwardly inclined blower fan for use in commercial HVAC units. The housing assembly is provided with a slanted wall to which a fan supply motor is slidably mounted. The slanted wall, in conjunction with an opposite non-parallel side wall, two other walls and a top plate form an enclosed area in which the fan is rotatably mounted. Air enters the fan in a straight path through a single front inlet opening provided in the assembly and exits the assembly via a large bottom discharge opening. Air flowing out the bottom discharge opening is evenly distributed over heating elements provided in the unit adjacent to the assembly. The assembly is slidably mounted in the unit for ease in removing it from the unit.

14 Claims, 2 Drawing Sheets

BLOWER FAN HOUSING ASSEMBLY

BACKGROUND OF THE INVENTION

1. Field of the Invention

The present invention pertains to a housing assembly containing a backwardly inclined blower for use in heating and air conditioning units, and more particularly, to a blower housing assembly for use in units such as those employed in commercial and industrial installations.

2. Description of the Related Art

Nearly all residential and many commercial heating, ventilation, and air conditioning (HVAC) units employ forwardly curved centrifugal blowers in order to draw air into the HVAC units from the spaces to be heated or cooled and to simultaneously push heated or cooled air from the units back into the spaces to be heated or cooled.

Forwardly curved centrifugal blowers are used in these types of HVAC units where duty is comparatively light and it is desirable to keep the initial cost of the HVAC unit low. When compared with other centrifugal blowers, such as, for example, backwardly inclined centrifugal blowers, the forward curved type is the least expensive to purchase but is also the most lightweight in construction, requiring that it be used at a low operating speed in order to avoid unsteady performance. Backwardly inclined blowers, on the other hand, although heavier and more expensive to manufacture than forwardly curved blowers, increase in efficiency at higher operating speeds and pressures.

In selecting a HVAC unit for commercial or industrial installations, customers are beginning to consider the total cost to own a HVAC unit, rather than simply purchasing the least expensive equipment. The total cost of owning a HVAC unit includes the initial equipment costs and the costs associated with operating the equipment. Forwardly curved blowers are considerably less efficient than backwardly inclined blowers. Therefore, HVAC units employing forwardly curved blowers, although lower in initial cost, have a higher total cost due to the inefficiency of these types of blowers. Stated differently, commercial and industrial HVAC units employing backwardly inclined blowers are less expensive in total cost when compared with units employing forward curved blowers because backwardly inclined blowers are so much more efficient and economical to operate, despite their higher initial equipment cost.

Another factor besides initial equipment cost which has prevented widespread use of backwardly inclined blowers in these types of HVAC units has been the ease of installation and serviceability afforded by the lighter weight, forwardly inclined blower. The forwardly curved blower and its associated housing are light in weight and considerably easier to slide out of the HVAC unit when it is necessary to service the blower than would be the heavier backwardly inclined blower if it were installed in the HVAC unit.

Another disadvantage associated with commercially available blowers, and especially those of the forwardly curved blade type, is that the outlet opening of the blower housing assembly does not create an even and equal distribution of air flowing to the heating coils. The heating coils are typically located immediately adjacent to the outlet or discharge opening of the blower. Uneven air flow around the heating coils decreases the efficiency of the heat transfer taking place between the heating coils and the air flowing around those coils, thereby further decreasing the efficiency of the HVAC unit's performance.

The present invention addresses these problems by providing an improved blower fan housing assembly which employs the more efficient backwardly inclined blower. The present invention is provided with at least one specially designed slanted wall which serves as a mounting place for the fan motor and creates an outlet opening which results in even and equal air distribution in the airstream flowing out of the blower and impinging on the heating coils of the HVAC unit. The resulting increases in efficiency achieved by this invention allow the blower to be powered by a smaller horse power supply fan motor than would be possible with a conventional forwardly curved blower and operated at considerable less cost than a unit employing a forwardly curved blower.

One object of the present invention is improvement in the flow pattern of air entering and leaving the blower. Most air conditioners use double inlet fans which require air to turn 90° to enter the inlet cavity from each side of the blower. As the air passes through the blower blades, it is required to make another 90° turn as it moves to the blower discharge opening. Blower efficiency is lost through turbulence and inlet vortexes which may be induced by this air flow pattern. The single inlet of the present invention faces air moving toward the fan, permitting air to move in a direct path to the single inlet cavity. Once inside the blower, the air is required to make a single 90° turn in order to exit the blower, resulting in considerably less air turbulence. By decreasing air turbulence, the present invention is able to operate more efficiently and quieter.

The invention is provided with slidable mounts so that it can be easily inserted or removed from a HVAC unit in order to facilitate repair or replacement. Because the fan supply motor is adjustably mounted onto the slanted wall of the invention, the motor is removed as a unit with the blower fan, unlike units employing conventional forwardly curved blowers where the blower and its supply motor are separately attached to the HVAC unit. By having the supply motor attached directly to the blower fan housing of the present invention, the belt, the fan pulley and the supply motor pulley can be aligned and adjusted while the components are removed from the confines of the HVAC unit, further contributing to its ease in servicing.

SUMMARY OF THE INVENTION

The present invention is an energy efficient, improved blower fan housing assembly for use in a commercial HVAC unit. The assembly is preferably located adjacent to and within the unit immediately downstream in the unit's air flow path of the air filter and cooling coils of the unit and located adjacent to and immediately upstream in the unit's air flow path of the heating elements of the unit. The assembly is provided with four walls and a top plate which together form the boundaries of an enclosed area. The walls are first a front wall, second an opposite back wall which is parallel to the front wall, third a side wall which is perpendicular to both the front and back walls and is secured by its opposite ends to one end of each of the front and back walls, and fourth a slanted wall which is located opposite the side wall and is not parallel with the side wall and is secured by its opposite ends, respectively, to opposite ends of the front and back walls so that a first distance measured between an upper end of the slanted wall and the side wall is shorter than a second distance measured between a lower end of the slanted wall and the side wall. The top plate secures to the four walls on a top side of the assembly.

The front wall is provided with a front inlet opening located directly in line with airflow coming from the cooling coils. Air flows in a straight path through the front inlet opening into a center cavity of a backwardly inclined blower fan rotatably mounted within the enclosed area. The fan rotates around a fan shaft which extends through a shaft opening provided in the back wall of the assembly. The fan shaft is rotatably secured within the shaft opening via bearings provided on the back wall adjacent to and surrounding the shaft opening. The fan shaft is provided with a fan pulley located external to the enclosed area. A belt engages the fan pulley and a drive pulley provided on a motor drive shaft of a fan supply motor. The fan supply motor is slidably mounted via motor mounting tracks provided on the slanted wall external to the enclosed area, and the motor is preferably activated by electricity in order to turn the fan.

When the fan is turning, air enters the center cavity, as previously described, is forced outward between adjacent fan blades, which are provided on the fan, into the enclosed area external to the fan. From there air flows downward through a large bottom discharge opening formed by lower extremities of the four walls. The air flowing out the bottom discharge opening forms a uniform stream of air which impinges on the heating elements, where heat transfer occurs, before the air ultimately flows out of the unit.

Edges on the lower extremities of the front wall and the back wall slidably support the assembly on assembly tracks provided within the unit to allow the assembly to be easily moved out of or back into the unit, facilitating replacement or repair of the assembly and its components.

DETAILED DESCRIPTION OF THE PREFERRED EMBODIMENT

Invention

Figure 3:
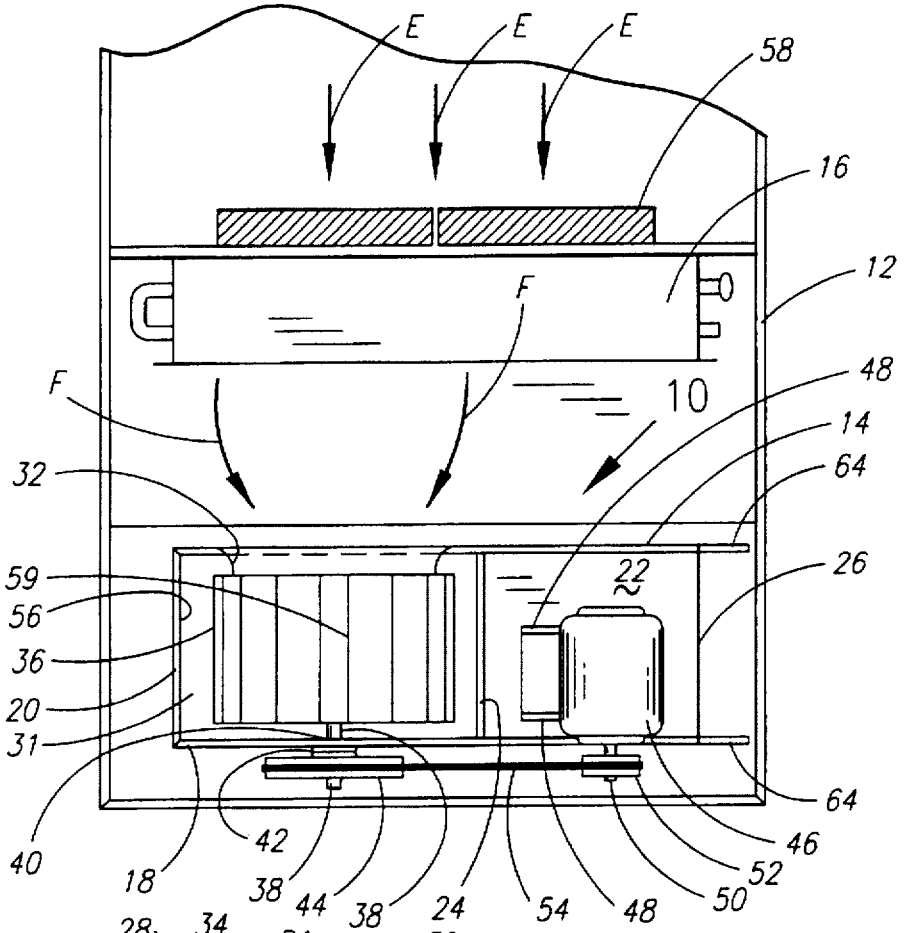
FIG. 3 is a partially cut away top plan view of an improved blower fan housing assembly constructed in accordance with a preferred embodiment of the present invention, shown with its top plate removed and shown as it would appear installed within a HVAC unit.
Figure 4:
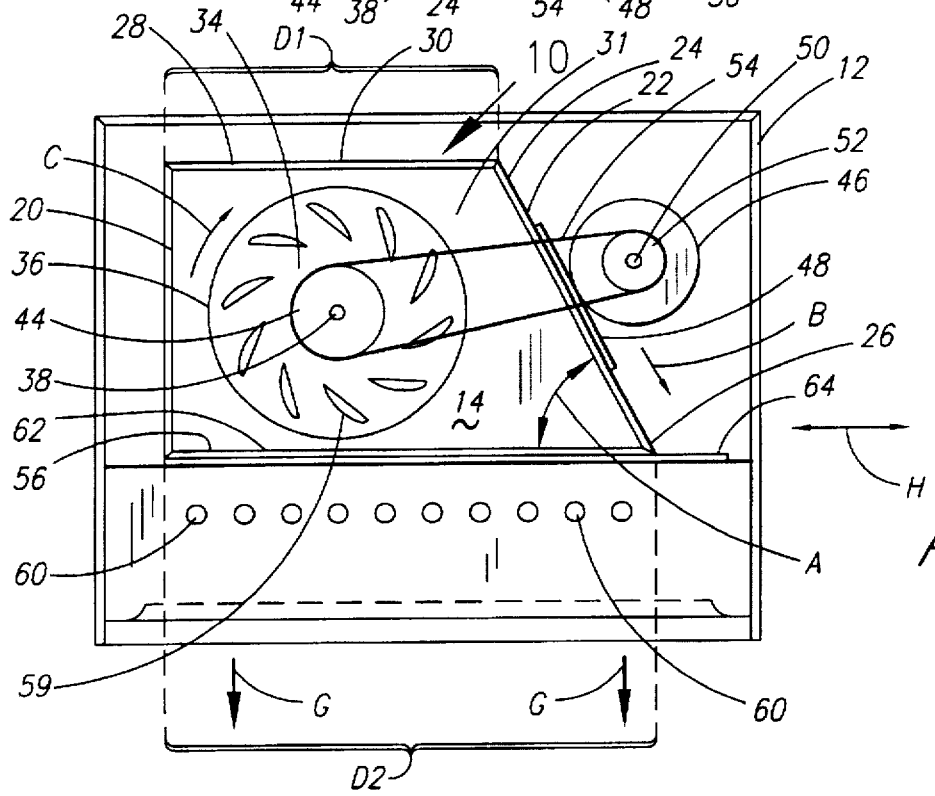
FIG. 4 is a partially cut away rear elevation of the assembly of FIG. 3.

Referring now to the drawings and initially to FIGS. 3 and 4, there is illustrated an improved blower fan housing assembly 10 constructed in accordance with a preferred embodiment of the present invention. The assembly 10 shown in FIGS. 3 and 4 is slidably mounted within a HVAC unit 12. The assembly 10 is provided with a front wall 14 located adjacent to a cooling coil 16 provided within the unit 12.

The assembly 10 is provided externally with four walls: the front wall 14, a back wall 18, a side wall 20 and a slanted wall 22. The back wall 18 is approximately parallel with the front wall 14, and opposite ends of the side wall 20 attach respectively to one end of each of the front and back walls 14 and 18 so that the side wall 20 is approximately perpendicular to both the front and back walls 14 and 18. The slanted wall 22 is located opposite the side wall 20 and opposite ends of the slanted wall 22 attach respectively to an opposite end of each of the front and back walls 14 and 18 so that the slanted wall 22 is not parallel with the side wall 20. The slanted wall 22 is offset from horizontal at an angle "A" such that an upper end 24 of the slanted wall 22 is located a first distance D1 from the side wall 20 and an opposite lower end 26 of the slanted wall 22 is located a second distance D2 from the side wall 20, with the first distance D1 being shorter than the second distance D2.

Although the side wall 20 has been described as perpendicular to both the front and back walls 14 and 18, the side wall 20 may be constructed so that it is not perpendicular to the front and back walls 14 and 18. But regardless of whether or not the side wall 20 is perpendicular to the front and back walls 14 and 18, it is important that the second distance D2 exceeds the first distance D1 in order that air exiting the assembly 10 form a uniform flow, as will be more fully described hereinafter.

The upper end 24 of the slanted wall 22 and upper ends respectively of the front, back and side walls 14, 18, 20 are joined to a top plate 28 in such a manner that the assembly 10 is completely sealed on its top side 30. The top plate 28 and the walls 14, 18, 20 and 22 define an enclosed area 31 within the assembly 10.

The front wall 14 is provided with a front inlet opening 32 which allows air to communicate with a center cavity 34 of a backwardly inclined blower fan 36 rotatably mounted on a fan shaft 38 within the enclosed area 31 of the assembly 10. The fan shaft 38 extends through a shaft opening 40 provided in the back wall 18 and is rotatably secured to the assembly 10 via a pair of bearings 42 provided on the back wall 18, external to the enclosed area 31 and adjacent the shaft opening 40. The fan shaft 38 rotatably extends through the bearings 42 and is provided with a fan pulley 44 attached thereto such that the fan pulley 44 is located external to the enclosed area 31.

A fan supply motor 46 slidably mounts on motor mounting tracks 48 provided external to the enclosed area 31 on the slanted wall 22. The fan supply motor 46 is preferably powered by electricity, although the electrical connections are not illustrated in the drawings. The assembly 10 is not limited to use with an electrically powered fan supply motor 46, and may be used in conjunction with any suitable type of motor. The fan supply motor 46 is provided with a rotatable motor drive shaft 50 on which a drive pulley 52 is secured. A belt 54 movably engages the drive pulley 52 and the fan pulley 44 in order for the fan 36 to be rotated when the fan supply motor 46 is activated.

Because of the angle "A" at which the slanted wall 22 is oriented from horizontal, by sliding the fan supply motor 46 upward on the motor mounting tracks 48, the drive pulley 52 moves toward the fan pulley 44, thereby releasing tension on the belt 54. When tension on the belt 54 is thus released, the belt 54 may be easily removed from the pulleys 52 and 44. Removing the belt 54 from the pulleys 52 and 44 facilitates repairing or replacing the fan supply motor 46 or the fan 36 or removing or replacing the belt 54, the drive pulley 52, the fan pulley 44, the bearings 42 or the fan 36.

Similarly, the belt 54 is tightened in its engagement with the pulleys 52 and 44 whenever the fan supply motor 46 is moved downward on the motor mounting tracks 48 because this causes the drive pulley 52 to move away from the fan pulley 44. The force of gravity on the motor 46 tends to cause the motor 46 to creep downward on the motor mounting tracks 48, thus keeping tension on the belt 54 as the belt 54 stretches and expands slightly with use. This downward movement of the motor 46 is shown by arrow B in FIG. 4.

Each of the walls, 14, 18, 20 and 22, terminates at its lower extremity along a common horizontal plane and lower edges of their extremities jointly define a bottom discharge opening 56.

When the motor 46 is activated, the fan 36 rotates in the direction shown by arrow C in FIG. 4. Rotation of the fan 36 pulls air into the HVAC unit 12, then, as shown by arrows E, pulls air through air filters 58 located within the unit 12 adjacent the cooling coils 16. Air next passes around the cooling coils 16 before entering the assembly 10 via the front inlet opening 32, as illustrated by arrows F. After air travels through the front inlet opening 32 is enters the center cavity 34 of the rotating fan 36. Rotation of blades 59 provided in the fan 36 force air outward from the center cavity 34, between adjacent blades 59, and into the enclosed area 31 external to the fan 36. From here, air moves downward in the enclosed area 31 and exits the assembly 10 via the bottom discharge opening 56. Air flowing out of the assembly 10 travels around heating elements 60 provided within the unit 12 adjacent to the bottom discharge opening 56 of the assembly 10. The slanted wall 22 of the assembly 10 and the assembly's large bottom discharge opening 56 cause air flowing to the heating elements 60 to impinge uniformly on the heating elements 60, thus optimizing heat transfer between the heating elements 60 and air. From there, air is then directed away from the heating elements 60, as illustrated by arrows G in FIG. 4. Air finally is pushed out of the HVAC unit 12 into a space to be heated or cooled, depending on whether the unit 12 is being operated with the cooling coil 16 functioning or is being operated with the heating elements 60 functioning.

Adjacent the bottom discharge opening 56, the front wall 14 and the back wall 18 are each provided at their lower extremities with edges 62 slidably supporting the assembly 10 on parallel assembly tracks 64 provided within the unit 12. The edges 62 can be moved in sliding fashion relative to the assembly tracks 64 in order to easily remove the assembly 10 from the unit 12 for servicing. Because the motor 46 mounts to the slanted wall 22, it is removed from unit 12 with the assembly 10. Once serving of the assembly 10 is completed, the assembly 10 can be reinserted into the unit 12, or alternately, a new replacement assembly (not illustrated, but identical to assembly 10) can be inserted into the unit 12 while repairs are being made on the original assembly 10. This movement of the assembly 10 out of and back into the unit 12 is shown by the double headed arrow H in FIG. 4.

Comparison of Invention to Prior Art

Figure 1:
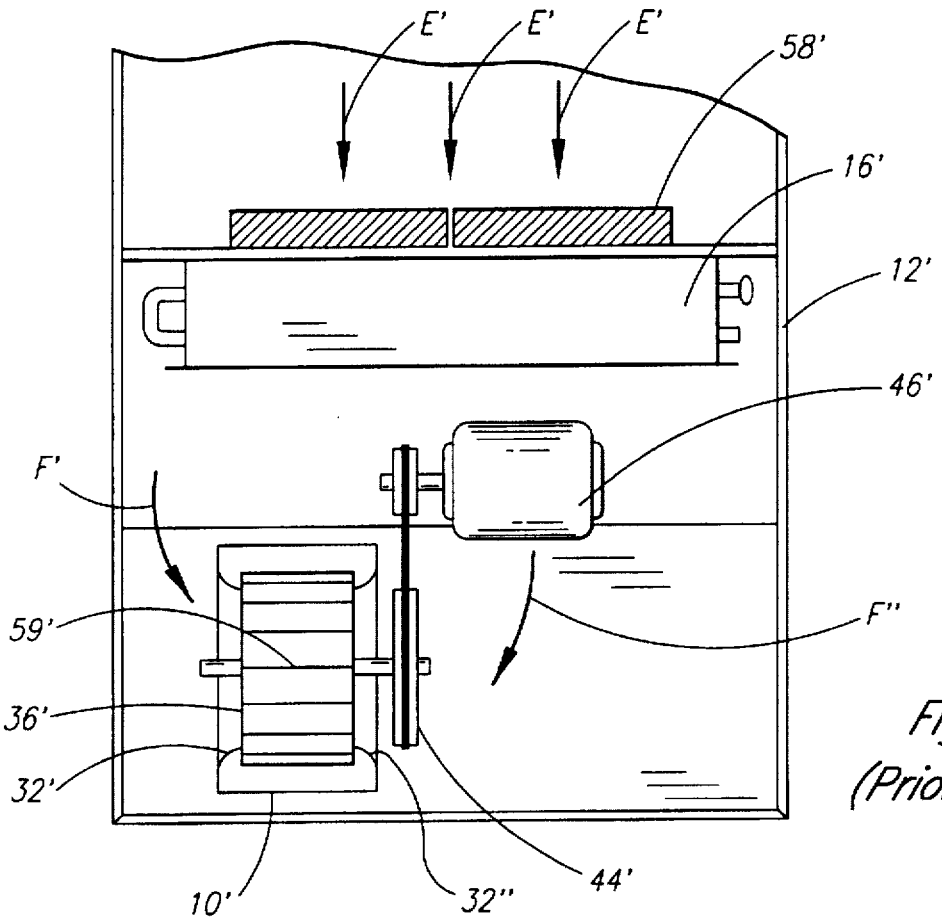
Fig. 1 (Prior Art)
FIG. 1 is a partially cut away top plan view of a conventional prior art forwardly curved fan blower, shown as it would appear installed within a HVAC unit.
Figure 2:
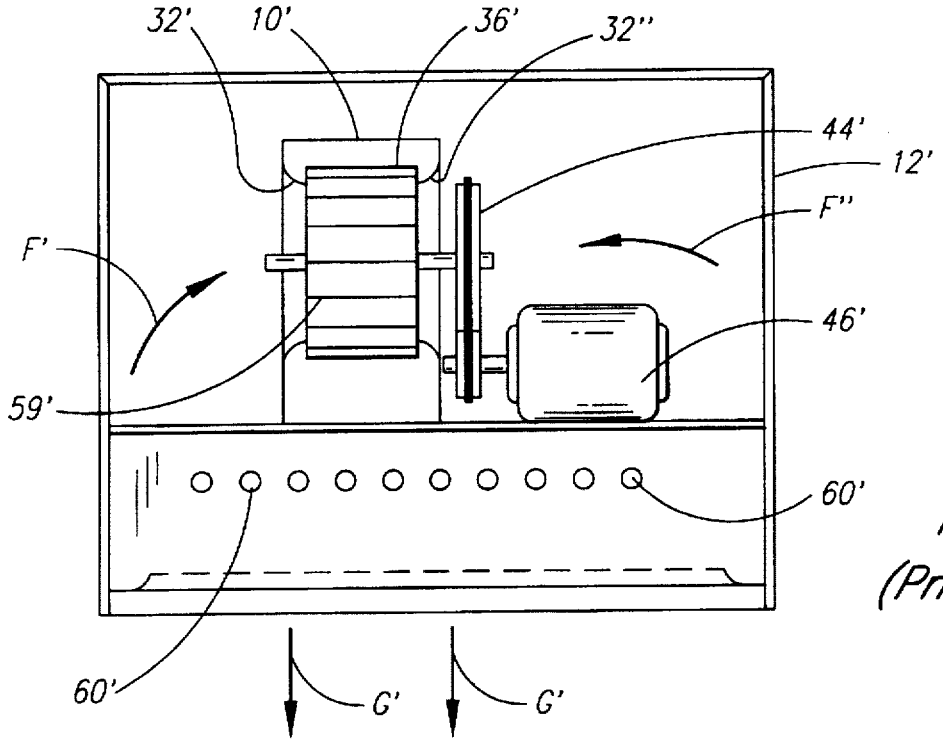
Fig. 2 (Prior Art)
FIG. 2 is a partially cut away rear elevation of the forwardly curved fan blower of FIG. 1, shown with the back wall removed.

To understand the present invention, it must be compared to a typical prior art HVAC unit. Referring now to FIGS. 1 and 2, there is illustrated a prior art HVAC unit 12' which employs a forwardly curved fan 36'. In the prior art unit 12', a larger horsepower fan supply motor 46' is required because of the decreased efficiency of the fan 36' . This motor 46' mounts directly to the unit 12', rather than mounting on a housing 10' of the fan 36'.

The air flow just described for the unit 12 employing the assembly 10 can be compared with air flow through the prior art unit 12' by referring to FIGS. 1 and 2.

First referring to FIG. 1, rotation of the fan 36' pulls air into the unit 12', then, as shown by arrows E', pulls air through air filters 58' located within the unit 12' adjacent cooling coils 16'. Air next passes around the cooling coils 16'. Up to this point, air has followed the identical path through unit 12' as previously described for unit 12. However, at this point, air leaving the cooling coils 16' must split into two streams, as shown by arrows F' and F", appearing in both FIGS. 1 and 2. Each of the two airstreams F1 and F2 must make a 90° turn in order to enter the fan 36' via two opposite fan openings 32' and 32". Additional air turbulence is created in unit 12' as compared to unit 12 because of the split of air into two air streams F1 and F2 as the air flows around the fan housing 10', a turn of approximately 90° required of each of the two air streams F' and F" in order to enter the fan 36' via fan openings 32' and 32", the partial blockage and air turbulence in air flow F" due to rotation and location of a fan pulley 44' adjacent fan opening 32" and the reconveyance of the two airstreams F1 and F2 within the fan 36'.

After entering the fan 36', air is forced between adjacent blades 59' provided on the fan 36' and then forced downward within the fan housing 10', exiting the fan housing 10' via a bottom discharge opening 56' provided in the fan housing 10'. As shown by arrows G', the air flowing from the bottom discharge opening 56' to adjacent heating elements 60' flows so that it does not uniformly impinge on all heating elements 60', thus resulting in sub-optimum heat transfer between the heating elements 60' and the air. Once air passes the heating elements 60', it flows out of the unit 12' into a space to be heated or cooled in a manner similar to that described in relationship to unit 12'.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An energy efficient, improved blower fan housing assembly employing a backwardly inclined blower fan for use in a commercial heating ventilation and air conditioning unit comprising, four walls attached at their side edges so as to define an enclosed area therebetween, edges of a top plate attaching to upper edges of said four walls, at least one wall of said four walls being oriented at an angle from horizontal so that an upper end of said at least one wall is a shorter distance to an opposite wall of the four walls than a second distance measured between a lower end of said at least one wall and said opposite wall, lower extremities of said four walls forming a bottom discharge opening which communicates with said enclosed area, and a front wall of said four walls being provided with a front inlet opening which communicates with a center cavity of a backwardly inclined blower fan rotatably mounted within said enclosed area.

2. An assembly according to claim 1 further comprising, lower edges provided on lower extremities of each said front wall and an opposite back wall of said four walls, said lower edges movably engaging assembly tracks provided within a HVAC unit in order that the assembly can be removed from the unit by sliding said lower edges along said assembly tracks.

3. An energy efficient, improved blower fan housing assembly employing a backward inclined blower fan for use in a commercial heating ventilation and air conditioning unit comprising, four walls attached at their side edges so as to define an enclosed area therebetween, edges of a top plate attaching to upper edges of said four walls, at least one wall of said four walls being oriented at an angle from horizontal so that an upper end of said at least one wall is a shorter distance to an opposite wall of the four walls than a second distance measured between a lower end of said at least one wall and said opposite wall, lower extremities of said four walls forming a bottom discharge opening which communicates with said enclosed area, a front wall of said four walls being provided with a front inlet opening which communicates with a center cavity of a backwardly inclined blower fan rotatably mounted within said enclosed area, motor mounting tracks provided on said at least one wall external to said enclosed area, and a fan supply motor movably engaging said motor mounting tracks.

4. An assembly according to claim 3 further comprising, said fan supply motor being provided with a rotatable motor drive shaft, a drive pulley securing to said motor drive shaft, a fan shaft securing to said backwardly inclined blower fan, said fan shaft rotatably extending through a shaft opening provided in a back wall of said four walls, bearings being provided on said back wall adjacent to and surrounding said shaft opening, said bearings rotatably securing said fan shaft to said back wall, a fan pulley being secured to said fan shaft, and a belt engaging said fan pulley and said drive pulley so that the backwardly inclined blower fan rotates when the fan supply motor is activated.

5. An assembly according to claim 4 wherein movement of said fan supply motor along said motor mounting tracks upward toward an upper end of said at least one wall causes said drive pulley to move toward said fan pulley thereby reducing tension on said belt, and movement of said fan supply motor downward toward a lower end of said at least one wall along said motor mounting tracks causes said drive pulley to move away from said fan pulley thereby increasing tension on said belt.

6. An assembly according to claim 5 wherein said front wall and said back wall movably secure within a HVAC unit so that air passing from a cooling coil provided in the HVAC unit is consecutively moved into the fan via the front inlet opening, passes between blades of the backwardly inclined blower fan, exits the enclosed area via the bottom discharge opening, and then passes over heating elements provided in the HVAC unit.

7. An energy efficient, improved blower fan housing assembly employing a single inlet backwardly inclined blower fan comprising:

a front wall and an approximately parallel back wall spaced apart from each other, a side wall having two opposite ends which secure respectively to one end of the front wall and one end of the back wall, a slanted wall which is non-parallel with said side wall and is spaced apart from said side wall, said slanted wall having two opposite ends which secure respectively to opposite ends provided on said front wall and said back wall, said front, back, side and slanted walls being sealed on their upper ends so as to define an enclosed are therebetween and being open on their lower ends, a backwardly inclined blower fan being rotatably mounted within said enclosed area, and said front wall being provided with a front inlet opening through which air enters the fan.

8. An assembly according to claim 7 wherein a first distance measured between the upper ends of the slanted wall and the side wall is less than a second distance measured between the lower ends of the slanted wall and the side wall.

9. An assembly according to claim 7 further comprising a top plate sealing the upper ends of the front, back, side and slanted walls.

10. An assembly according to claim 7 wherein the lower ends of the front, back, side and slanted walls form a bottom discharge opening through which air exits the enclosed area.

11. An assembly according to claim 7 wherein said backwardly inclined blower fan is a single inlet type.

12. An assembly according to claim 7 further comprising:

said lower ends of said front and said back walls each being provided with edges which support the assembly and, said edges movably engage parallel assembly tracks provided on a HVAC unit.

13. An assembly according to claim 7 further comprising:

a fan shaft being provided on said backwardly inclined blower fan, said fan shaft rotatably extending through a shaft opening provided in said back wall, said fan shaft rotatably secured to said back wall by bearings attaching to said back wall adjacent and surrounding said shaft opening, a fan pulley secured to said fan shaft external to said enclosed area.

14. An energy efficient, improved blower fan housing assembly employing a single inlet backwardly inclined blower fan comprising:

a front wall and an approximately parallel back wall spaced apart from each other, a side wall having two opposite ends which secure respectively to one end of the front wall and one end of the back wall, a slanted wall which is non-parallel with said side wall and is spaced apart from said side wall, said slanted wall having two opposite ends which secure respectively to opposite ends provided on said front wall and said back wall, said front, back, side and slanted walls being sealed on their upper ends so as to define an enclosed are therebetween and being open on their lower ends, a backwardly inclined blower fan being rotatably mounted within said enclosed area, said front wall being provided with a front inlet opening through which air enters the fan, a fan shaft being provided on said backwardly inclined blower fan, said fan shaft rotatably extending through a shaft opening provided in said back wall, said fan shaft rotatably secured to said back wall by bearings attaching to said back wall adjacent and surrounding said shaft opening, a fan pulley secured to said fan shaft external to said enclosed area, motor mounting tracks provided on said slanted wall external to said enclosed area, a fan supply motor movably securing to said motor mounting tracks, a drive motor shaft rotatably provided on said fan supply motor, a drive pulley secured to said drive motor shaft, and a belt movably engaging said drive pulley and said fan pulley such that the fan rotates when the fan supply motor is activated.

* * * * *